US006036382A

United States Patent [19]

Middleton

[11] Patent Number: 6,036,382

[45] Date of Patent: Mar. 14, 2000

[54] RIBBON TRANSPORT MECHANISM HAVING DRIVEN PIVOTING CARRIER BEAM AND METHOD OF USING

[75] Inventor: Alan Peter Middleton, Stamford, United Kingdom

[73] Assignee: Willett International Limited, United Kingdom

[21] Appl. No.: 09/133,936

[22] Filed: Aug. 14, 1998

[30] Foreign Application Priority Data

Aug. 16, 1997 [GB] United Kingdom ..... 9717327

[51] Int. Cl.[7] ..... B41J 33/14

[52] U.S. Cl. ..... 400/225; 400/248

[58] Field of Search ..... 400/218, 223, 400/225, 227, 227.2, 234, 248

[56] References Cited

U.S. PATENT DOCUMENTS

| | | | |
|---|---|---|---|
| 584,497 | 6/1897 | Eckels | 400/219.5 |
| 1,937,145 | 11/1933 | Gollwitzer | 400/230 |
| 2,884,111 | 4/1959 | Damerau | 400/248 |
| 3,939,957 | 2/1976 | Bittner | 400/234 |
| 4,507,667 | 3/1985 | Tsuboi | 400/234 |
| 4,840,504 | 6/1989 | Chu et al. | 400/248 |
| 5,533,819 | 7/1996 | Watanabe et al. | 400/225 |

FOREIGN PATENT DOCUMENTS 2 306 916 5/1997 United Kingdom .

*Primary Examiner*—John Hilten
*Assistant Examiner*—Leslie J. Grohusky
*Attorney, Agent, or Firm*—Charles D. Gunter, Jr.; Felsman, Bradley, Vaden Gunter & Dillon, LLP

[57] ABSTRACT

The present invention relates to a mechanism for transporting a printing ribbon past the print head of a printer using a rocking beam mechanism the rocking beam being driven by a drive means. The invention also provides a printer, notably a thermal printer, incorporating such a transport mechanism and a method for operating the printer.

8 Claims, 3 Drawing Sheets

RIBBON TRANSPORT MECHANISM HAVING DRIVEN PIVOTING CARRIER BEAM AND METHOD OF USING

The present invention relates to a device, notably a device for advancing the printing ribbon in a thermal transfer printer.

BACKGROUND TO THE INVENTION

In British Patent Application No 2 306 916 A1 there is proposed a device, the prior art device, for transporting the ribbon in a thermal transfer or other printer past the print head in which a shuttle mechanism acts upon the ribbon on either side of the print head. Due to the fact that the shuttle draws a double sided loop of material with it as it reciprocates, the ribbon is transported past the print head at twice the speed of the shuttle. Such a mechanism is thus of especial application in printing onto substrates which are moving rapidly past the print head. A conventional printer ribbon transport mechanism using driven ribbon supply and take up reels cannot achieve fast transport of the ribbon in accurate increments due to the inertia of the reels. The rapid start and stop action of such a conventional feed mechanism may also apply excessive stresses on the ribbon leading to breakage of the ribbon. The use of a shuttle mechanism is claimed to avoid such stresses.

The use of a shuttle mechanism is also claimed to achieve accurate registration of the printer ribbon with the print head since the shuttle achieves accurate movement of the ribbon in known increments past the print head. In the preferred embodiment, the shuttle mechanism is driven by a belt loop carrying the shuttle secured to the belt and travelling upon linear guide rails. The belt is moved in one direction or the other by means of a stepper motor so that the belt and hence the shuttle moves a specified and fixed distance at each movement of the belt. However, such a shuttle mechanism is complex to construct and operate and requires that the shuttle be repeatedly accelerated and decelerated at each end of its reciprocal travel. Furthermore, it is necessary to ensure accurate linear travel of the shuttle by means of guide means, which require to be manufactured to a high degree of accuracy if they are not to be prone to jam. This is particularly the case where the print head, which must accurately depress the ribbon into contact with the moving substrate, is carried on the shuttle mechanism. This adds to the cost of manufacture and maintenance of the shuttle mechanism.

We have now devised a device which reduces the complexity of the prior art device. In the device of the invention, the linearly moving shuttle of the prior art device is replaced by a rocking beam mechanism. This can be operated without the need for guides to guide its movement using a single stepper motor resulting in a simpler mechanism which is less prone to jam. The amount of ribbon transported past the print head can readily be varied by simply varying the angle through which the beam rocks. Furthermore, the speed and/or the amount of ribbon transported can also be varied simply by varying the effective length of the beam and/or by providing additional pairs of ribbon guides on the rocking beam so that two or more loops of ribbon are drawn on each side of the print head as described below. In the device of the prior art, it is necessary to vary the length of travel of the shuttle in order to vary the amount of ribbon transported past the print head. Whilst the length of travel, or throw, of each stroke of the shuttle mechanism can be increased or decreased by varying the number of rotations of the stepper motor driving the drive belt which carries the shuttle, it is not possible to increase the speed at which that increased amount of ribbon travels past the print head. As a result, the prior art device cannot readily accommodate changes in the length of the message printed on the substrate (and hence the length of ribbon to be carried past the print head) without slowing the speed at which the substrate travels past the print head. The use of a rocking beam mechanism enables the speed of transport of the ribbon past the print head to be increased at a given stepper motor speed simply by increasing the effective length of the beam.

The use of a rocking beam mechanism thus provides a number of advantages over the device of the prior art and gives the operator a mechanism whose ribbon transport can be readily adjusted by simple adjustment of the effective length of the beam.

SUMMARY OF THE INVENTION

Accordingly, the present invention provides a transport mechanism for transporting a printer ribbon from a ribbon supply reel, past a print head and to a used ribbon take up reel, which mechanism comprises:

a. a ribbon transport path from the supply reel to the used ribbon take up reel via the print head; and b. a first and a second pair of ribbon guide means located in said path, the first pair being located on the ribbon feed side of the print head and the second pair being located on the ribbon removal side of the print head; and c. a first and a second moveable ribbon guide means located in said path, the first moveable ribbon guide means being located between the guide means of said first pair of ribbon guide means and the second moveable guide means being located between the guide means of said second pair of ribbon guide means; and d. a carrier beam member pivoting about a pivot point and carrying said moveable ribbon guide means, the first moveable guide mean being located to one side of said pivot point and the second moveable ribbon guide means being located on the other side of said pivot point, whereby pivoting of said beam about said pivot point by a drive means acting on said beam causes said moveable ribbon guide means to move relative to said ribbon travel path and thus transport the ribbon along said path.

Whilst the invention may be applied to various forms of printer using a printer ribbon, the invention is of especial application to thermal transfer printers in which the print head comprises an array of independently actuated heat emitting elements, typically heat emitting diodes or transistors, each of which acts upon a thermal transfer ribbon to cause part of the image forming material on the ribbon to fuse and transfer from the ribbon onto a substrate with which the ribbon is in contact. Such print heads, their design, construction, operation and ribbons for use therewith are well known in the art and the invention may be applied to a wide range of commercially available forms of such printer. For convenience, the invention will be described hereinafter in terms of such a thermal transfer printer and ribbon.

The ribbon path from the supply reel to the used ribbon take up reel via the print head can be of conventional layout and form, using conventional supply and take up reels. For convenience the term reel is used herein to denote any means by which a ribbon can be stored and released for transport past the print head and includes conventional drum or reel type devices in which the drum or reel is rotatably mounted on a shaft, boxes of fan folded ribbon and the like. For convenience, the invention will be described hereinafter in terms of a conventional rotating drum type of reel.

Typically, the used ribbon take up reel is provided with a stepper motor or other drive means by which the reel is caused to take up used ribbon. The un-used ribbon supply reel can be provided with a magnetic clutch or other braking means to reduce over-run in the supply of ribbon from that reel. If desired braking nip rollers can be provided in the ribbon path between the supply reel and the print head to prevent take off of ribbon from the supply reel when the loops of ribbon on either side of the print head are being formed or discharged as described below. The ribbon guide means can be pulleys, rollers or low friction guide plates. One of each ribbon guides in the first and second pairs of guides can be provided by the supply and/or take up reel. For convenience, the invention will be described hereinafter in terms of the use of freely rotating rollers mounted on static support shafts. However, if desired, one or more of the ribbon guides can be provided by the nip gap between a pair of rollers, one of which is driven or braked so as to provide further control of the travel of ribbon along the ribbon path of the invention. If desired, the ribbon guides can be on a spring loaded or otherwise biased chassis so that the ribbon guides can move against the bias to accommodate any sudden movements of the ribbon, for example during the start and/or end of a swing of the rocking beam. Thus, the ribbon path may be provided with one or more jockey wheels to absorb the increased tension in portions of the ribbon and/or to maintain tension within the ribbon.

The pairs of ribbon guide means can be located at any suitable point to either side of the print head. However, it will usually be preferred to provide the supply and take up reels above the level of the print head so that the path of travel of the ribbon is generally along three sides of a square or rectangle. The pairs of ribbon guides are located on two opposed sides of the print head with the print head approximately centrally between them, typically in the bottom or intermediate side of the square path. The outward ribbon guide of each pair can form the guide at the bottom corners of such a square or rectangular path about which the ribbon travels from the supply reel or to the take up reel to the intermediate side of the square. The substrate to be printed travels along a path below and substantially parallel to the intermediate side of the square. The print head can be moved, either linearly or by pivoting, to bring the printing elements into contact with the ribbon so as to depress the ribbon into contact with the substrate during the printing operation. The substrate may be sufficiently rigid to provide the support against which the print head presses the ribbon to achieve transfer of the image forming component from the ribbon to the substrate during the printing operation, as is usually the case where the substrate is a wall of a carton, box or other container. However, where the substrate is flexible, as is usually the case with a label or other sheet of paper, a roller or flat bed platen can be provided under the substrate in register with the print head. Such ribbon travel paths, platens and print head operation are of conventional form and operation.

Located between the ribbon guides in each pair is a moveable guide, one on the feed side of the print head and the other on the used ribbon take up side. These two guides can be of any suitable form, but are conveniently freely rotating rollers. The moveable guides can be located substantially in the straight line path between the guides of the first and second pairs of guide. However, it is preferred that the moveable guides be off set from that straight line path so that the rocking beam mechanism carrying the moveable guides can be accommodated within the central space within the square or rectangular path of travel. In this manner, the ribbon follows a looped path around the guides in each pair and its associated moveable guide, and the beam moves the moveable guides along a path transverse to the straight line between the guides in each pair of guides to form or increase a loop as the moveable guide moves away from the pair of guides and collapses or reduces the loop as it moves towards the pair of guides.

The moveable guides are carried by a beam member which pivots about a pivot point between the two moveable ribbon guides. As the beam pivots, the moveable guides each move relative to their associated pair of ribbon guides to form or collapse a loop of ribbon to each side of the print head. As indicated above, the beam pivots to move the moveable ribbon guides generally transversely to the straight line between the guides in each pair of guides so as to form or collapse loops of ribbon extending normally to the straight line path of ribbon between each pair of guides. As the loops are formed and collapsed ribbon is drawn off the supply reel and past the print head. In order to avoid stresses within the ribbon path, it is desirable that the moveable ribbon guides be mounted equidistant from the pivot point of the beam so that equal lengths of ribbon are drawn off the supply reel and past the print head.

The beam can take any suitable form which provides a fixed support for the moveable ribbon guides and yet does not impose excessive load and inertia on the motor or other means causing the beam to pivot. Thus, the beam can take the form of a conventional axially extending beam or plate pivoting about its centre point upon a transverse pin or shaft and bearing assembly located generally in line with the print head so that the loops of ribbon drawn by the moveable members lie substantially symmetrically to either side of the print head. However, other forms of beam may be used if desired, for example a disc or arcuate plate. For convenience, the invention will be described hereinafter in terms of a linear beam pivoting about a transverse shaft, the beam being orientated generally parallel to the line of travel of ribbon past the print head.

The beam carries the moveable ribbon guides thereon. The guides conveniently take the form of freely rotating rollers or the like journalled upon shafts extending transversely from the beam. The shafts can be fixedly secured to the beam. However, it is preferred that the position of the guides upon the beam should be adjustable about the pivot point. Thus, the shafts can be a screw or other fit into a locating boss or recess in the beam and a plurality of such bosses or recesses can be provided as an axially extending series along the beam symmetrically about the pivot point. In this way, the effective length of the beam, that is the distance between the moveable ribbon guide and the pivot point, can readily be adjusted by moving the shafts to bosses or recesses closer to or further from the pivot point. Alternatively, a single boss can be provided for each moveable ribbon guide and the axial position of this boss upon the beam adjusted by a screw or other adjustment means. Preferably, such adjustment means for each boss is interlinked with the adjustment means for the other boss so that both bosses move together and for the same distance.

As indicated above, the beam preferably carries a moveable guide located to each side of the pivot point of the beam so that a single loop of ribbon is formed and collapsed at each side of the print head. However, it is within the scope of the present invention for the beam to carry two or more pairs of moveable guides so that two or more loops of ribbon are formed or collapsed to each side of the print head for each pivot of the beam. The use of such multiple pairs of moveable guides enables larger amounts of ribbon to be drawn past the print head per unit time during the printing operation, thus giving the operator of the printer yet greater flexibility in operating the printer.

The beam is caused to pivot by any suitable means. Thus, a stepper or other motor can rotate a cam which bears against the underside of the beam to cause that portion of beam to rise and fall as the cam is rotated and thus pivot the beam about its pivot point against a spring or other bias to ensure that the beams engages the cam. The extent of the angle through which the beam pivots will depend upon the eccentricity of the cam and the point on the beam at which the cam bears. Movement of the cam along the length of the beam can thus be used to vary the angle through which the beam pivots. Alternatively, a stepper or other motor can drive the shaft upon which the beam is supported and the angle through which the beam pivots is varied by the angle through which the drive shaft of the motor rotates. However, such a direct drive may impose excessive loads on the motor and it will usually be desired to drive the beam through a reduction gear mechanism. This may act upon the shaft on which the beam is pivoted. However, it is preferred to provide the beam with a gear toothed member, for example an arcuate or other member attached to the beam, upon which the motor acts. For a given rotation of the motor or cam, the above mechanisms achieve a given angle of rotation of the beam and hence a given arcuate movement of the moveable ribbon guides carried by the beam. This will form or collapse a loop of ribbon of a given size on each side of the print head and thus transport a given length of ribbon past the print head at each operation of the beam. If the position of the moveable guides upon the beam is changed, the size of the loops formed and collapsed and hence the amount of ribbon drawn past the print head will change. However, this changed amount will be drawn past the print head in the same time span, whatever the position of the moveable guides upon the beam. The use of the rocking beam mechanism of the invention thus maintains a constant print time over a range of ribbon transport lengths which is not readily achievable with the prior art device.

The device of the invention can be operated in a manner similar to a conventional thermal or other ribbon printers except that the ribbon can be transported rapidly past the print head in accurately predetermined increments which can readily be adjusted by adjustment of the angle through which the beam is pivoted and/or by the axial position of the moveable ribbon guides upon the beam and/or by the number of moveable guides carried by the beam. The operation of the various components of the transport mechanism of the invention can be interlinked by any suitable mechanical and/or electronic or electrical means and suitable forms of such interlink and control means are commercially available or can be readily devised.

The invention thus also provides a thermal transfer printer in which an image is formed by applying a print head to a ribbon, characterised in that the ribbon is transported past the print head by a device of the invention.

DESCRIPTION OF THE DRAWINGS

The invention will now be described by way of illustration only with respect to the accompanying drawings in which.

DESCRIPTION OF THE PREFERRED EMBODIMENT

Figure 1:
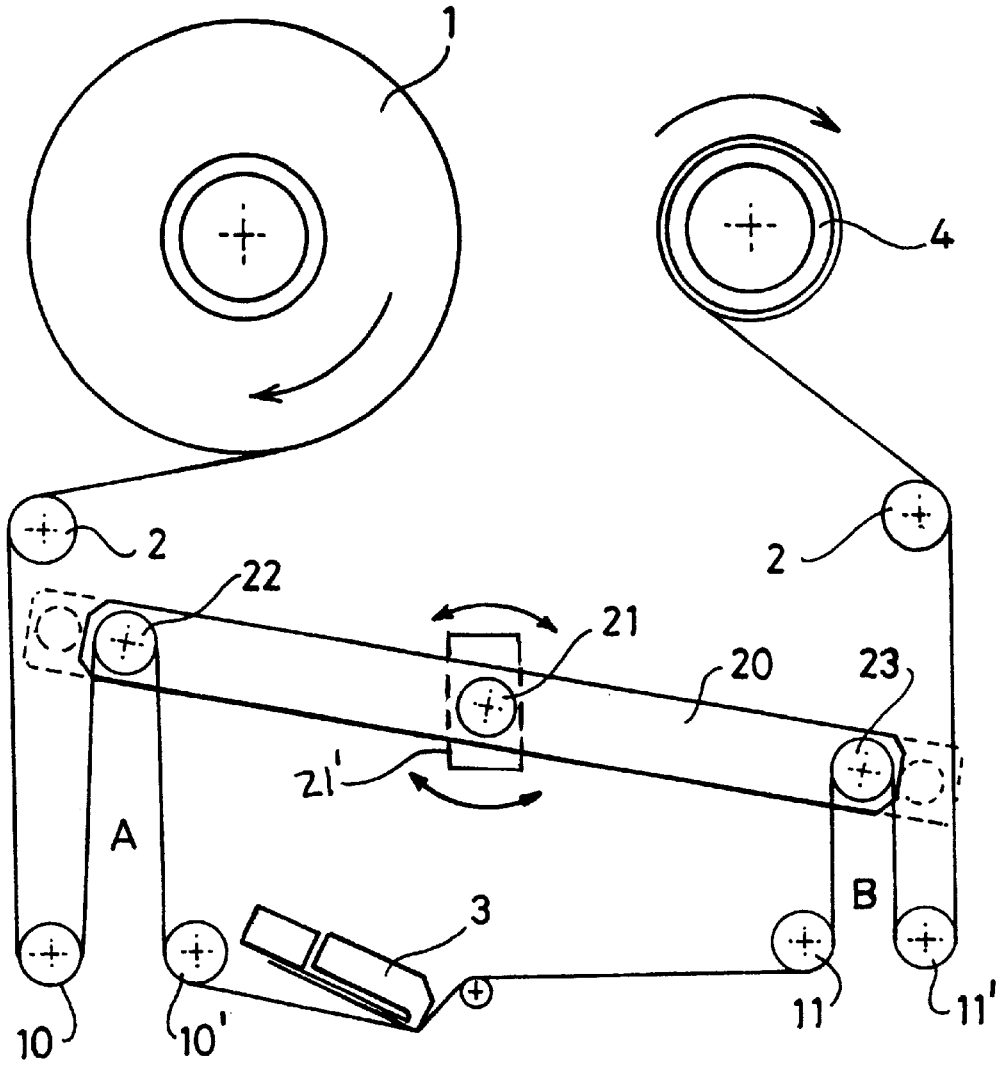
FIG. 1 is a diagrammatic view of the path of travel of the ribbon through a device of the invention with the beam pivoted to its full extent in one direction.
Figure 2:
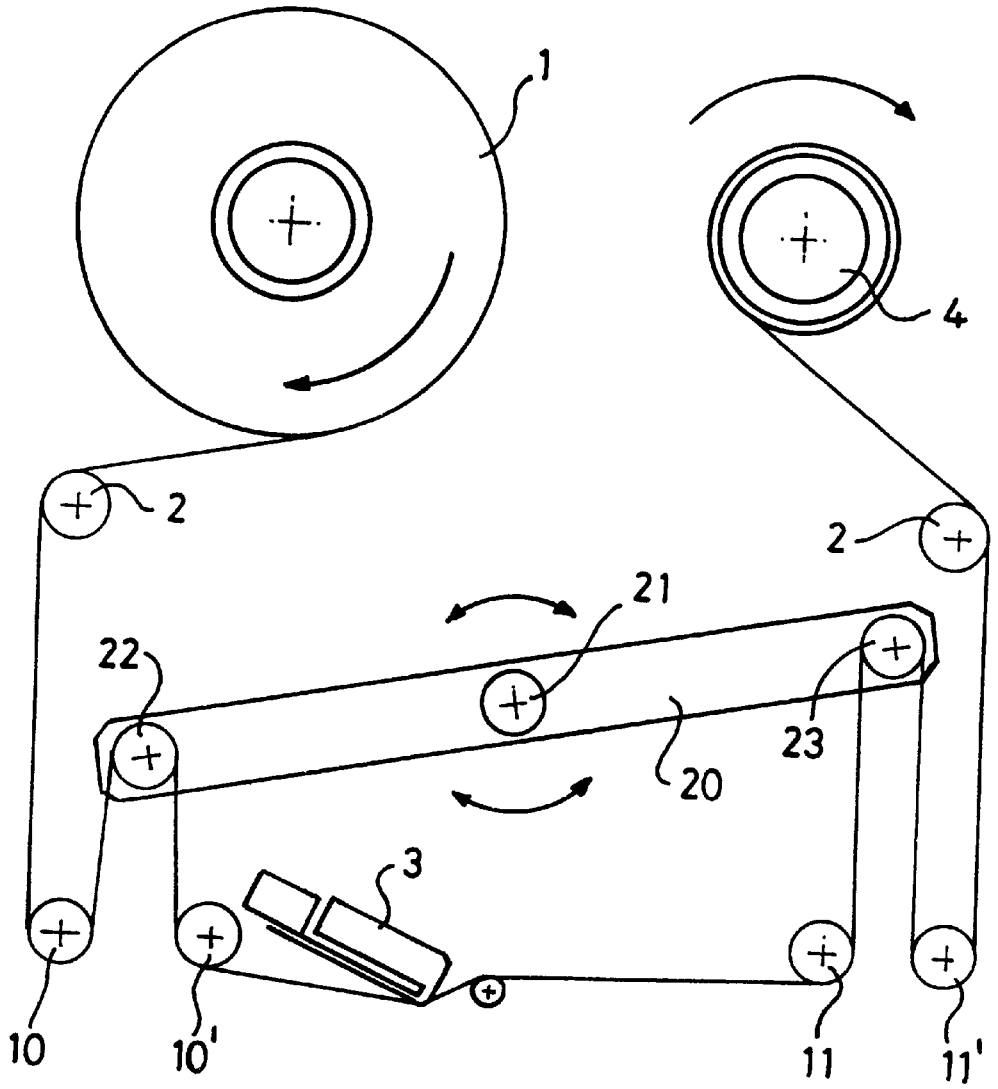
FIG. 2 is a diagrammatic view of the device of FIG. 1 with the beam pivoted to its full extent in the opposite direction.
Figure 3:
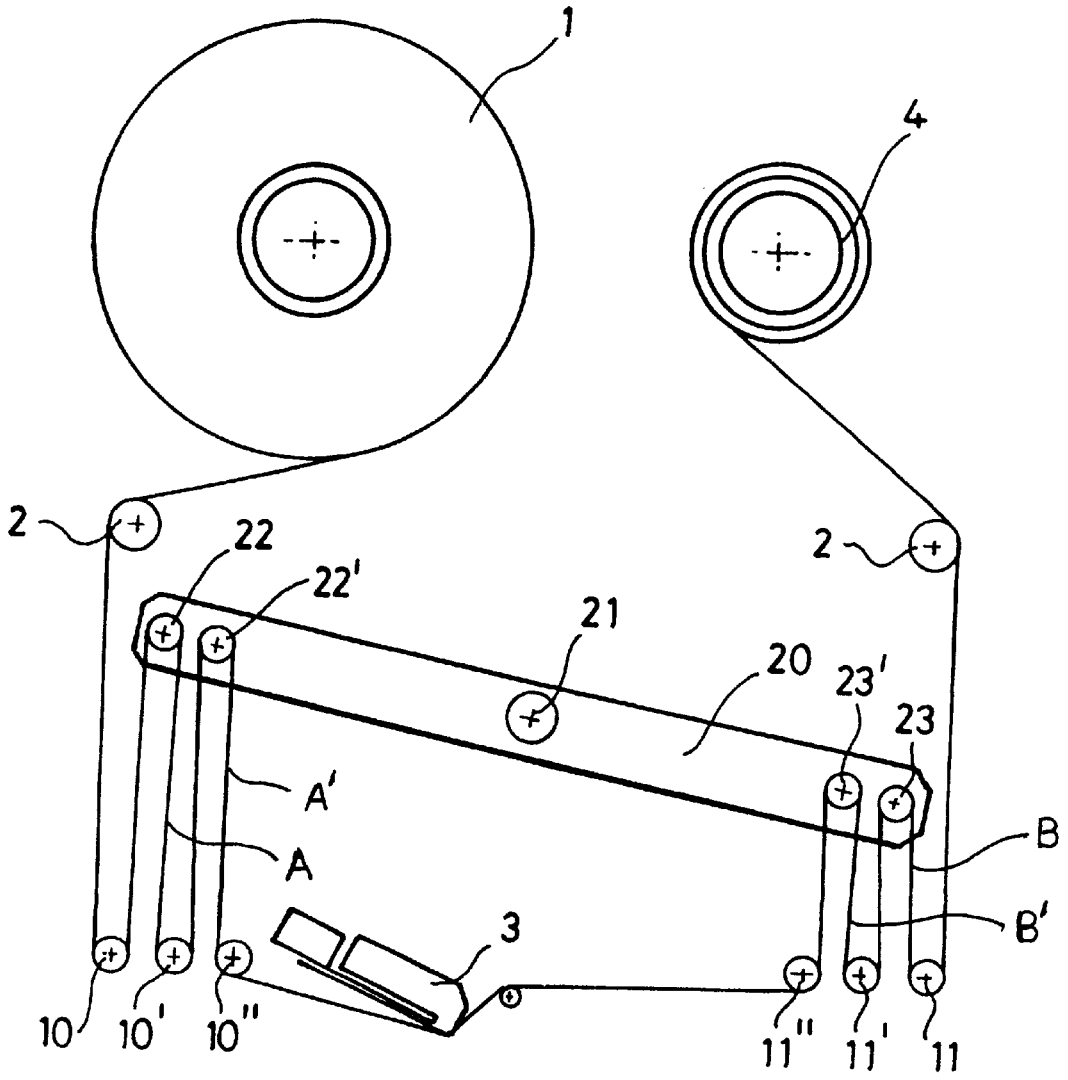
FIG. 3 is a diagrammatic view of the device of FIG. 1 carrying two sets of moveable guides on the beam.

The device as shown in FIG. 1 comprises a conventional ribbon supply reel 1, ribbon guides 2 (which may be spring loaded to act as jockey wheels to absorb sudden tensions in the ribbon), a thermal print head 3 and a used ribbon take up reel 4. These components are supported on a suitable plate or frame to form a generally right angled U shaped ribbon travel path between the reels 1 and 4 with the print head 3 being located in the closed end of the U. The print head 3 is shown in FIG. 1 in its printing position at which is bears against the ribbon to depress the ribbon into contact with the substrate on which the image is to be printed. In its dwell position as shown in FIG. 2, the print head is pivoted or otherwise moved so that it still contacts the ribbon but does not depress the ribbon into contact with the substrate to be printed, thus allowing the substrate to move with respect to the ribbon and print head. The reels 1 and 4 can incorporate magnetic or other clutches or drive mechanisms as is conventional. At each end of the bottom leg of the ribbon travel path are the first and second pairs of ribbon guides 10, 10' and 11 and 11' with the print head 3 located between them. Above the print head is located a beam 20 extending generally parallel to the bottom leg of the path and pivoting about a generally central pivot shaft 21. The beam is pivoted by a drive mechanism 21' comprising a toothed wheel driven by a stepper motor engaging an arcuate toothed member connected to the beam 20. Adjacent each end of the beam 20 are located the moveable ribbon guides 22 and 23. The ribbon follows looped paths A and B between the guides of each of the first and second pairs 10, 10' and 11, 11' and their associated guides 22 and 23 as shown. As shown in FIG. 3, the beam 20 can carry two sets of moveable guides 22, 22' and 23, 23' so that two loops A, A' and B, B' of ribbon are drawn on each side of the print head 3, and an additional ribbon guide 10" and 11" will be required. This form of construction will approximately double the amount of ribbon drawn past the print head as the beam is pivoted.

In operation, beam 20 is pivoted fully clockwise to adopt the position shown in FIG. 1. This action causes guide 22 to move away from the straight line between guides 10 and 10' and this draws fresh ribbon off the supply reel 1 to form a loop A of un-used ribbon on the upstream side of the print head 3. In pivoting to this position, the loop B of used ribbon on the downstream side of the print head 3 is collapsed or reduced to allow used ribbon to be taken up on reel 4. The take up reel 4 is preferably driven by a stepper motor or the like through a magnetic or other clutch to take up the used ribbon released from loop B and to prevent ribbon being drawn backwards into loop A; and reel 1 is lightly braked to avoid excess un-used ribbon being drawn off reel 1. The print head is in its dwell position allowing the substrate upon which printing is to occur to be positioned under the print head. The print head is then moved to its print position as shown in FIG. 1 in readiness for the print operation so that its printing edge bears against the fresh ribbon positioned under the print head.

For the printing operation, the heating elements of the print head are energised in the desired sequence to cause discrete areas of the image forming material carried by the ribbon to fuse and transfer to the substrate as the beam 20 is pivoted in an anti-clockwise direction. This causes loop B to be enlarged, thus drawing ribbon past the print head 3 so that the print head prints an image onto the substrate which is moving past the print head at the same speed as the ribbon. Loop A is reduced in phase with the enlargement of loop B and no ribbon is drawn off reel 1 until beam 20 adopts the position shown in FIG. 2. At this point, loop B contains used ribbon and the supply of fresh ribbon initially held in loop A is exhausted.

Print head 3 is then moved to its dwell position to allow the substrate to be moved away from the printer. Beam 20 is pivoted clockwise to return to the position shown in FIG. 1 during which loop A is re-created and loop B is discharged to the take up reel 4 in readiness for another print operation.

To accommodate faster travelling substrates, the speed of the drive for beam 20 can be increased. However, the amount of ribbon drawn past the print head 3 for each printing operation will remain the same. If it is desired to increase the amount of ribbon drawn past the print head, this can be done by increasing the angle through which the beam 20 pivots. However, this will require a longer time to complete at a given ribbon travel speed. This may be acceptable where the message or image printed onto the substrate can be longer. However, where the message print time cannot be elongated, a longer beam 3 can be used (as shown dotted) so that the guides 22 and 23 are located further from the pivot point of the beam. This will have the effect of drawing more ribbon past the print head, because loops A and B will be larger. However, since the beam will pivot through the same angle in the same time as a shorter beam, the larger amount of ribbon will be drawn past the print head 3 in the same time.

The transport mechanism of the invention can be supplied as a retro-fit assembly for incorporation into existing printers; or can be incorporated into printers ab initio as they are manufactured. The invention therefore also provides a thermal transfer printer incorporating a transport mechanism of the invention for transporting the ribbon past the print head.

The invention also provides a method for operating a printer of the invention so as to print an image on a surface of a substrate into contact with which the print head has brought the ribbon in register with the print head, characterised in that:

a. the beam member is pivoted about its pivot point in a first direction so as to move the first moveable ribbon guide means with respect to said ribbon path on the feed side of the print head so as to draw un-used ribbon from the ribbon supply reel and form a loop of un-used ribbon in the ribbon travel path on the ribbon feed side of the print head; and b. pivoting the beam member in the opposite direction so as to draw ribbon from said loop past the print head as the substrate to be printed travels past the print head and the print head is actuated to print the desired image on the substrate and use the ribbon, the used ribbon on the downstream side of the print head being formed into a loop of used ribbon by relative movement of said second moveable ribbon guide with respect to said ribbon travel path; and c. repeating step a by pivoting the beam member in said first direction so as to form a new loop in the ribbon on the ribbon feed side of the print head and to collapse the loop of used ribbon on the ribbon removal side of the print head; and d. interlinking the operation of the print head and the ribbon transport mechanism whereby used ribbon is progressively taken up by the ribbon take up reel.

The invention has been described above in terms of moving the ribbon in one direction past the print head by releasing any brake on the supply of un-used ribbon from the supply reel 1 and/or the drive of the used ribbon take up reel 4 in conjunction with the movement of the beam 20 using conventional electronic or other interlinking between the operation of the various components of the ribbon transport mechanism. However, it is also within the scone of the present invention to operate the interlinking mechanisms so that each cycle of operation of the beam 20 comprises the steps of:

a. pivoting the beam clockwise to draw un-used ribbon from the supply reel 1 to form the loop A on the feed or upstream side of the print head 3 and to collapse the loop B of used ribbon on the ribbon removal or downstream side of the print head 3 and allow that used ribbon to be taken up by used ribbon reel 4 and thus adopt the position shown in FIG. 1;

b. drawing the un-used ribbon from loop A past the print head 3 as described above for the printing operation by pivoting the beam 20 anti-clockwise, thus collapsing the upstream loop A and forming the downstream loop B with both the supply and take up reels 1 and 4 remaining static. The beam thus adopts the position shown in FIG. 2;

c. pivoting the beam 20 clockwise to adopt the position shown in FIG. 1 again, but not permitting un-used ribbon to be drawn off reel 1 and holding reel 4 static. This will cause the used ribbon from loop B in FIG. 2 to be drawn back to re-form loop A of FIG. 1. The beam can be pivoted to a slightly different position from that achieved in step a so that the repositioned ribbon does not have its used portions exactly in register with their initial position in step a with respect to the print head;

d. pivoting beam 20 anti-clockwise for a second printing operation during which the repositioned used ribbon from step c is transported past the print head again to adopt the position shown in FIG. 2; and e. repeating step a with reels 1 and 4 free to rotate and thus release further unused ribbon to form a new loop A and take up used ribbon from loop B.

In this way the ribbon can be passed twice or more past the print head to make more economical use of the ribbon than where a single ribbon pass is employed.

I claim:

1. A transport mechanism for transporting a printer ribbon from a ribbon supply reel, past a print head and to a used ribbon take up reel, which mechanism comprises:

a. a ribbon transport path from the supply reel to the used ribbon take up reel via the print head; and b. a first and a second pair of ribbon guide means located in said path, the first pair being located on a ribbon feed side of the print head and the second pair being located on a ribbon removal side of the print head; and c. a first and a second moveable ribbon guide means located in said path, the first moveable ribbon guide means being located between the guide means of said first pair of ribbon guide means and the second moveable guide means being located between the guide means of said second pair of ribbon guide means; and d. a carrier beam member pivoting about a pivot point and carrying said moveable ribbon guide means, the first moveable ribbon guide means being located to one side of said pivot point and the second moveable ribbon guide means being located on the other side of said pivot point; and e. a drive means pivoting said beam member about said pivot point by the drive means acting directly on said beam member causing said moveable ribbon guide means to move relative to said ribbon transport path and thus transport the ribbon along said path.

2. A mechanism as claimed in claim 1, characterised in that the number and/or position of the moveable ribbon guides upon the beam member relative to the pivot point of the beam member can be varied.

3. A mechanism as claimed in claim 1, characterized in that the beam member is a linear beam member located off set from but generally parallel to a portion of the ribbon travel path past the print head whereby the moveable ribbon guides are adapted to move transversely to the said portion of the ribbon transport path so as alternately to form and collapse loops in the ribbon to the feed and removal sides of the print head and between the associated pairs of ribbon guide means as the beam member is pivoted first in one direction and then in the opposite direction.

4. A mechanism as claimed in claim 1, characterised in that the ribbon guides means are provided by free rotating rollers or pulleys.

5. A thermal transfer printer having a ribbon transport mechanism for transporting a printer ribbon from a ribbon supply reel, past a print head, and to a used ribbon take up reel, the ribbon transport mechanism comprising:

a. a ribbon transport path from the supply reel to the used ribbon take up reel via the print head; and b. a first and a second pair of ribbon guide means located in said path, the first pair being located on a ribbon feed side of the print head and the second pair being located on a ribbon removal side of the print head; and c. a first and a second moveable ribbon guide means located in said path, the first moveable ribbon guide means being located between the guide means of said first pair of ribbon guide means and the second moveable guide means being located between the guide means of said second pair of ribbon guide means; and d. a carrier beam member pivoting about a pivot point and carrying said moveable ribbon guide means, the first moveable ribbon guide means being located to one side of said pivot point and the second moveable ribbon guide means being located on the other side of said pivot point; and e. a drive means, pivoting said beam member about said pivot point by the drive means acting directly on said beam member causing said moveable ribbon guide means to move relative to said ribbon transport path and thus transport the ribbon along said path.

6. A method for operating a printer having a ribbon transport mechanism so as to print an image on a surface of a substrate into contact with which a print head has brought a ribbon in register with the print head, the method comprising:

a. providing a ribbon transport path from a supply reel to a used ribbon take up reel via the print head; and b. also providing a first and a second pair of ribbon guide means located in said path, the first pair being located on a ribbon feed side of the print head and the second pair being located on a ribbon removal side of the print head; and c. further providing a first and a second moveable ribbon guide means located in said path, the first moveable ribbon guide means being located between the guide means of said first pair of ribbon guide means and the second moveable guide means being located between the guide means of said second pair of ribbon guide means; and d. further providing a carrier beam member pivoting about a pivot point and carrying said moveable ribbon guide means, the first moveable ribbon guide means being located to one side of said pivot point and the second moveable ribbon guide means being located on the other side of said pivot point; and e. further providing a drive means, whereby pivoting of said beam member about said pivot point by the drive means acting directly on said beam member causes said moveable ribbon guide means to move relative to said ribbon transport path and thus transport the ribbon along said path, f. wherein the beam member is pivoted about its pivot point in a first direction so as to move the first moveable ribbon guide means with respect to said ribbon path on the feed side of the print head so as to draw un-used ribbon from the ribbon supply reel and form a loop of un-used ribbon in the ribbon transport path on the ribbon feed side of the print head;

g. pivoting the beam member in the opposite direction so as to draw ribbon from said loop past the print head as the substrate to be printed travels past the print head and the print head is actuated to print the desired image on the substrate and use the ribbon, the used ribbon on a downstream side of the print head being formed into a loop of used ribbon by relative movement of said second moveable ribbon guide with respect to said ribbon transport path;

h. repeating step f by pivoting the beam member in said first direction so as to form a new loop in the ribbon on the ribbon feed side of the print head and to collapse the loop of used ribbon on the ribbon removal side of the print head; and i. interlinking the operation of the print head and the ribbon transport mechanism whereby used ribbon is progressively taken up by the ribbon take up reel.

7. A method as claimed in claim 6, characterized in that:

a. the beam member is pivoted in the first direction to draw un-used ribbon from the ribbon supply reel to form a loop A on the ribbon feed side of the print head and to collapse a loop B of used ribbon on the ribbon removal side of the print head and allow that used ribbon to be taken up by the used ribbon reel; and b. the un-used ribbon from loop A is drawn past the print head during operation of the print head by pivoting the beam member in the opposite direction, thus collapsing the loop A and forming loop B with both the ribbon supply and used ribbon take up reels remaining static;

c. pivoting the beam member in said first direction again, but not permitting un-used ribbon to be drawn off the ribbon supply reel, the used ribbon take up reel remaining static so as to cause the used ribbon from loop B to be drawn back past the print head to re-form loop A;

d. pivoting the beam member again in said opposite direction for a second printing operation during which the repositioned used ribbon in loop A from step c is transported past the print head again to re-form loop B; and e. repeating step a with the un-used ribbon supply reel and the used ribbon take up reel free to rotate and thus release further unused ribbon to form a new loop A and to take up used ribbon from loop B.

8. A method as claimed in claim 7, characterised in that the beam member is pivoted to a different position in step c from that achieved in step a so that the repositioned ribbon is not exactly in register with its position in step a with respect to the print head.

* * * * *